United States Patent [19]

Danley et al.

[11] 4,034,549

[45] July 12, 1977

[54] SHADOW CLOCK

[76] Inventors: Jon G. Danley, 1727 Seventh Ave., Greeley, Colo. 80631; Arthur L. Meisner, 6172 S. Garfield Drive, Littleton, Colo. 80121

[21] Appl. No.: 623,819

[22] Filed: Oct. 20, 1975

[51] Int. Cl.[2] ..... G04B 19/30; G04B 19/06

[52] U.S. Cl. ..... 58/50 R; 58/127 R

[58] Field of Search ..... 58/3, 50 R, 125–127; 240/6.43

[56] References Cited

U.S. PATENT DOCUMENTS

| | | | |
|---|---|---|---|
| 2,834,250 | 5/1958 | Stefani | 58/50 R |
| 3,430,433 | 3/1969 | Sandor | 58/50 R |
| 3,583,150 | 6/1971 | Faik | 58/50 R |
| 3,651,634 | 3/1972 | Cooper | 58/127 R |
| 3,832,842 | 9/1974 | Parker | 58/126 A |

*Primary Examiner*—E. S. Jackmon

[57] ABSTRACT

A shadow clock is provided which simulates a sundial by casting a shadow of a stylus created by relative movement between the stylus and one or more illuminated light sources to cast a shadow which moves across indicia on the face of a clock. In one embodiment, a triangular stylus is mounted to pivot about the center of the clock face and to cast a shadow of the stylus created by one of the illuminated light sources. The light sources are selectively illuminated when the stylus points to the number opposite each light source and projects a shadow of the stylus across the numbers as the stylus moves from a first number to a second number. Upon reaching the second number, the first light source is de-activated and the next light source which is now opposite the stylus is illuminated to cast a new shadow. In another embodiment, a single light source and stylus are mounted on a pivoted arm to cast a shadow of the stylus which moves progressively across indicia on a clock face. Alternatively, the light source may be stationary and only the stylus moves. In a further embodiment, a single light source and stylus move linearly along a clock face to cast a progressively moving shadow on indicia on the face. In a still further embodiment indicia moves along a linear path past a stationary shadow created by a stationary stylus and light source.

15 Claims, 27 Drawing Figures

SHADOW CLOCK

BACKGROUND OF THE INVENTION

1. Field of the Invention

This invention relates to a clock and more particularly to an electric clock which projects a real shadow of a stylus to simulate a sundial.

2. Description of the Prior Art

Various attempts have been made to provide illuminated clocks which are decorative yet highly functional. Furthermore, attempts have been made to simulate the age oil sundial in such a decorative clock. One such sundial clock is shown in U.S. Pat. No. 3,832,842 to Parker. In this device, a translucent face is provided on the clock which has a rotatable stylus extending beyond the face of the clock and a triangular opaque member behind the face of the clock which simulates the shadow of the stylus when the face of the clock is illuminated from the rear to give an indication of the time. While such a clock is decorative, it does not fully duplicate a sundial inasmuch as it does not project a real shadow of the stylus, but rather such a shadow is simulated by a separate opaque member behind the face of the clock.

SUMMARY OF THE INVENTION

In accordance with the present invention, a clock is provided for telling time by a real shadow cast by a stylus onto indicia on the face of the clock. A clock motor is connected to at least one of the stylus, light projecting means or face to cause relative movement between the shadow and the indicia in timed relation.

More particulary, a clock is provided in one embodiment having a face with indicia spaced therearound which include numbers located at 30° are positions to represent the hours of the day and smaller increments therebetween to repesent one or more minutes between the hours. A generally triangular stylus is mounted for rotation about the center of the face and has one leg extending perpendicular from the center and the other leg extending parallel to the face toward the indicia. The stylus is rotated by a clock motor mounted behind the face and illuminated light means spaced around the periphery of the face at each of the numbers illuminates the stylus selectively so that the stylus casts a shadow across the number opposite the illuminated light means to give a readable indication of time. Means is provided for selectively illuminating the light means opposite the number to which the stylus is pointing and remains iluminated until the stylus moves to the next numbr whereupon the next light will be illuminated so that the light means casts a shadow of the stylus across the indicia opposite the illuminated light source and the increments between that indicia and the position of the stylus.

In another embodiment, a single light source and stylus are mounted on a pivoted arm to cast a shadow of the stylus onto the clock face. In a still further embodiment, a light source and stylus move linearly along a clock face to cast a shadow which moves progressively along the clock face. Means for advancing the light source and stylus can take any of several forms, such as a screw advance or an endless belt which includes means to return the stylus and light source from one end of the clock face to the other.

From the foregoing, it can be seen that a clock is provided which simulates a sundial by projecting a real shadow of a stylus across the face of the clock to provide a readable indication of the time. Other novel features and advantages of the invention will become apparent from the description which follows taken in conjunction with the accompanying drawings.

DESCRIPTION OF THE PREFERRED EMBODIMENTS

Figure 1:
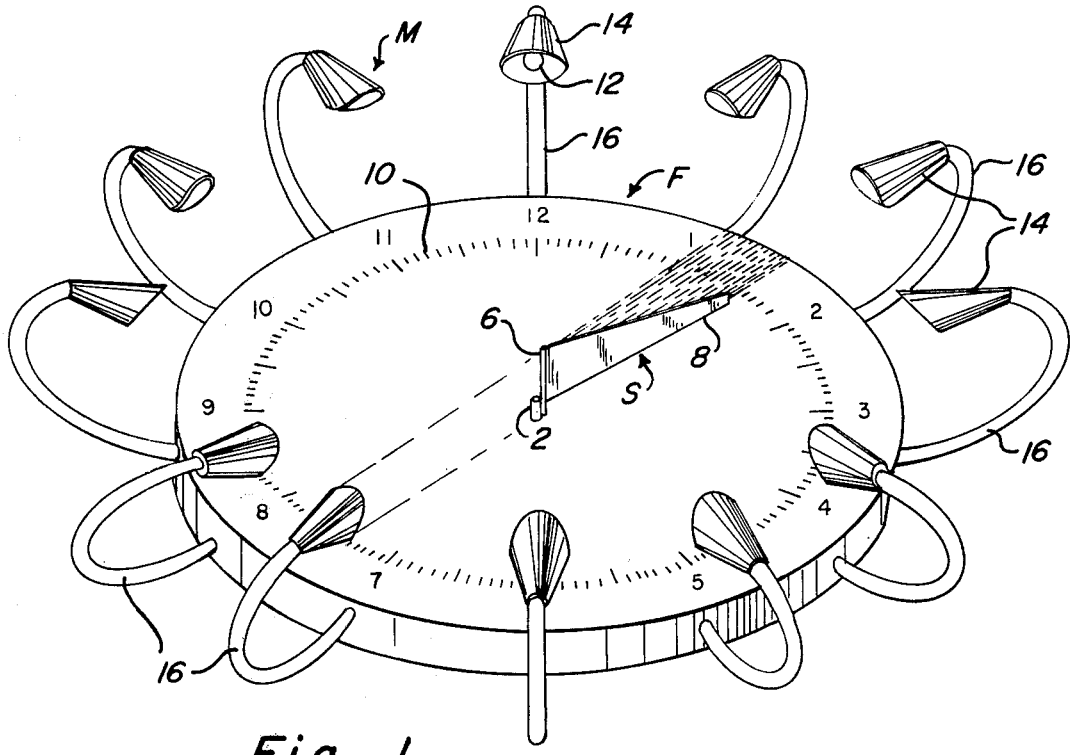
FIG. 1 is a perspective view of one form of a shadow clock constructed in accordance with this invention.

In accordance with one form of this invention, a clock is provided having a face F provided with indicia to indicate the hours and minutes of the day, as shown in FIG. 1. A triangular stylus S is mounted above the face F for rotation about the center of the face and is connected along one leg to a shaft 2 extending through the face to a clock motor 4, as sown in FIGS. 3 and 4. The stylus is triangular in shape and includes a first leg 6 extending perpendicular to the face and connected to shaft 2 and a second leg 8 extending parallel to the face of the clock so that the stylus will project a shadow on indicia 10 as described below.

Mounted around the periphery of the clock face F are a plurality of illuminating means M which each include a light 12 mounted within a shade 14 and supported on an arm 16 for projecting light from each of the hour marks on the face of the clock onto stylus S to cast a shadow of the stylus across the opposite portion of the face as more fully described below.

Figure 2:
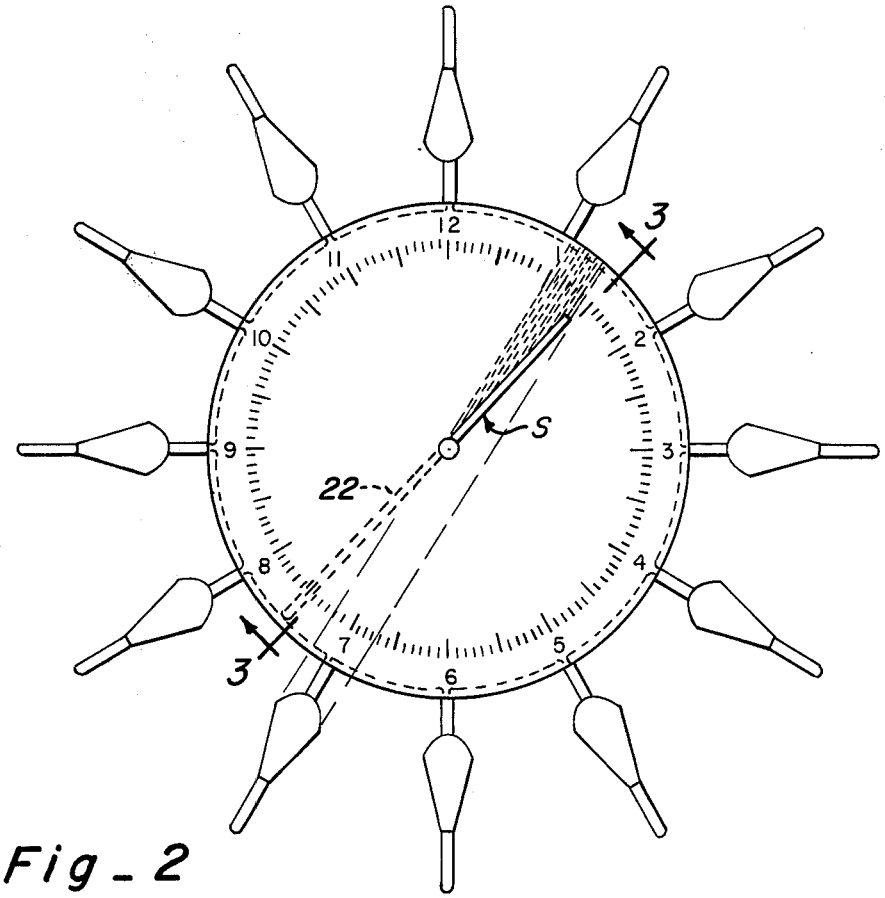
FIG. 2 is a plan view of the clock of FIG. 1.
Figure 3:
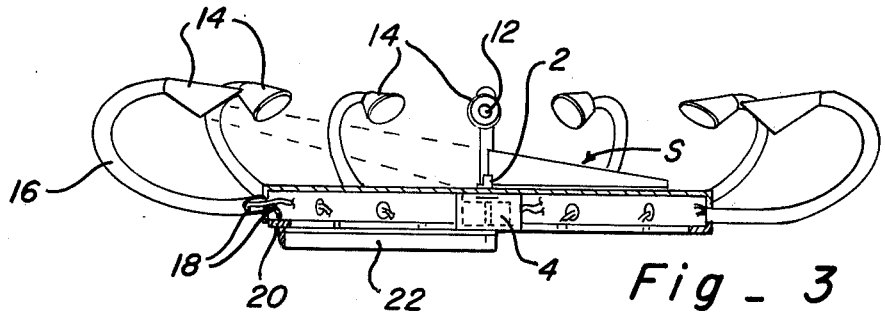
FIG. 3 is a horizontal section, taken along line 3—3 of FIG. 2, showing details of the light illuminating means.
Figure 4:
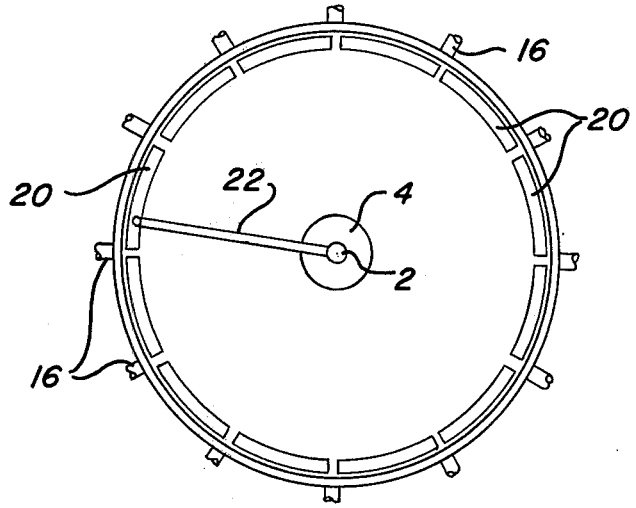
FIG. 4 is a bottom plan view of the clock of FIGS. 1–3.

As best seen in FIG. 3, wires 18 extend through arm 16 and connect to arcuate contact plates 20 which are engaged by sliding contact arm 22 which rotates with motor shaft 2. As best seen in FIGS. 2 and 3, contact arm 22 is mounted 180° from the position of stylus S on shaft 2. Also, arcuate segments 20 are positioned so that contact arm 22 first engages a contact plate at a numbered position on the clock face and the spacing between adjacent segments is such that as one segment is disconnected the next one becomes connected. Thus, it can be seen that when the stylus reaches the one o'clock position, for instance, the light at the seven o'clock position becomes illuminated and shines across stylus S. As the stylus continues to rotate, a shadow will be cast thereby across the one o'clock indicia mark and the succeeding indicia marks up to the point of the stylus, the shaded portion indicating the time, such as 1:25 as shown in FIG. 2. When the stylus reaches the two o'clock position, the contact arm 22 will move off the contact for the seven o'clock light and will de-activate it and turn on the eight o'clock light as it engages the next contact segment 20. In this manner, a real shadow will be cast by the stylus across a portion of the indicia representing the time from one indicia mark up to the next, such as between one o'clock and two o'clock as shown in FIGS. 1 and 2. Of course, it will be understood that the indicia may be in increments other than hours and minutes if such a different time designation is desired.

Figure 5:
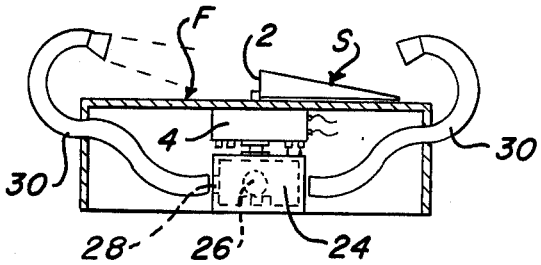
FIg. 5 is a horizontal section, similar to FIG. 3, but showing an alternative embodiment using fiber optics.
Figure 6:
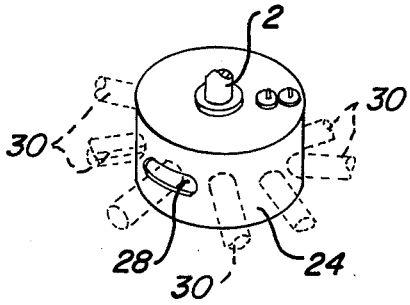
FIG. 6 is an enlarged perspective view of a portion of the fiber optics system of FIG. 5.
Figure 7:
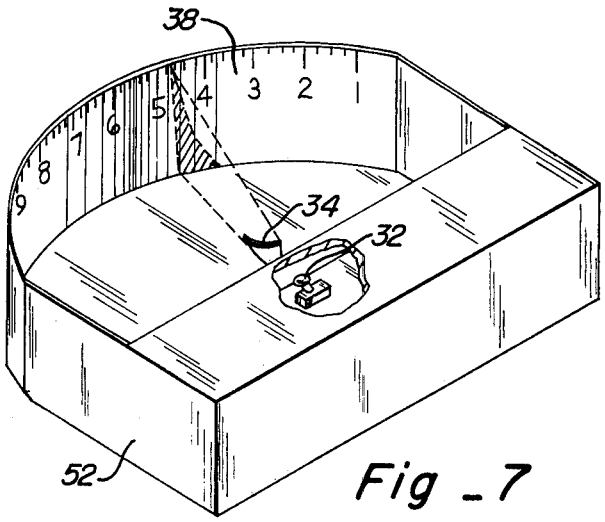
FIG. 7 is a perspective view of a desk top model shadow clock constructed in accordance with this invention.

As alternative embodiment is shown in FIG. 5 which also includes a stylus S mounted on a clock face F and pivotally connected to a shaft 2 rotatably driven by a motor 4. The rear end of shaft 2 is connected to a cup-shaped housing 24 which rotates therewith and is provided with a light source 26 in its interior. Furthermore, a slot 28 is provided in housing 24 and has a length equal to the length of the arc of one segment, such as 30°, for the distance between hours on the clock face F. Conveniently, separate fiber optics 30 extends from positions adjacent housing 24 to positions above the face for shining light across stylus S to illuminate the same and to cast a shadow across a portion of the face F as in the previous embodiment. The slot 28 is located on the side of housing 24 opposite stylus S so that light is furnished to the fiber optic opposite the stylus to cast a shadow as in the previous embodiment. Thus, in this embodiment only a single light source need be used and the electrical contacts associated with the previous embodiment are not required.

Figure 8:
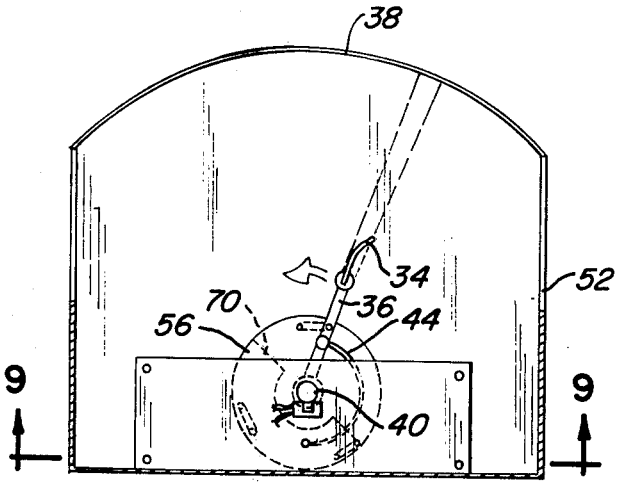
FIG. 8 is a top plan view of the shadow clock of FIG. 7 with certain parts broken away for clarity of illustration.
Figure 9:
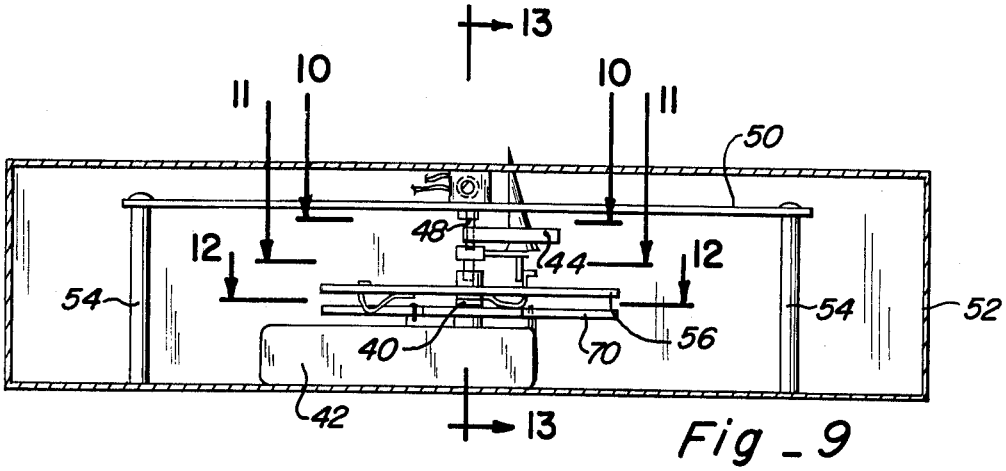
FIG. 9 is a vertical section, taken along line 9—9 of FIG. 8, showing further details of the mechanism of the clock.

In the embodiment of FIGS. 7–15, a desk top shadow clock is provided which includes a stationary light source 32 and a stylus 34 which is mounted at the end of an arm 36 which in turn is pivoted about its opposite end so that as the stylus swings from one side of the clock to the other, the light will cast a shadow of the stylus onto indicia on a linear clock face 38. Arm 36 is pivoted upon a shaft 40 of a clock motor 42, as best seen in FIG. 9. Thus, the clock motor will cause the stylus to be moved relative to clock face 38 over discrete time increments and light source 32 which is continuously illuminated will cast a shadow of stylus 34 onto the clock face. Conveniently, when the stylus reaches the end of its sweep it will be returned from the 12:59 position to the one o'clock position by means of flexible spring 44 connected at one end to arm 36 by pin 46 and connected at the other end to a pin 48 which is connected to a mounting support 50, as best seen in FIG. 9. Conveniently, the mounting support 50 is attached to housing 52 by means of spacing supports 54.

Figure 10:
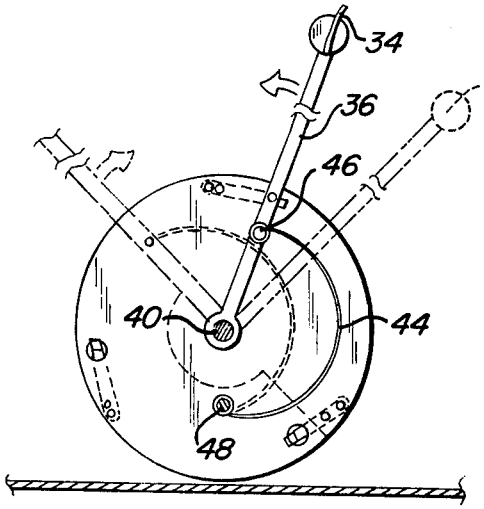
FIG. 10 is a horizontal section taken along line 10—10 of FIG. 9 showing the return spring mechanism.
Figure 11:
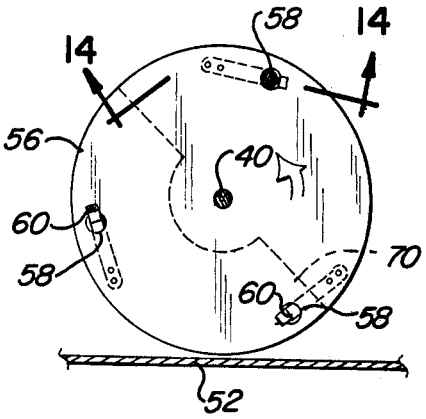
FIG. 11 is a horizontal section taken along line 11—11 of FIG. 9 showing a detent feature for oscillating the stylus arm.
Figure 12:
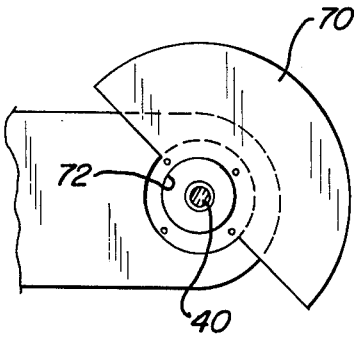
FIG. 12 is a section taken along line 12—12 of FIG. 9 showing the release mechanism for the detent system.
Figure 14:
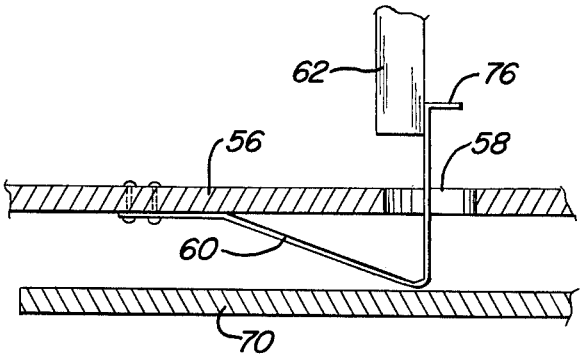
FIG. 14 is a fragmentary enlarged section showing the detent mechanism in raised position for oscillating the stylus.
Figure 13:
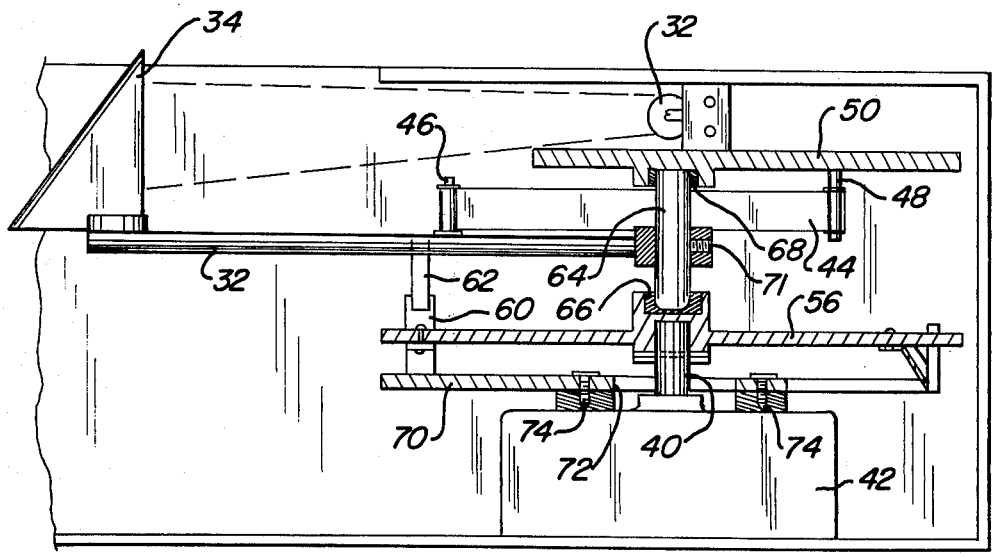
FIg. 13 is an enlarged fragmentary vertical section, taken along line 13—13 of FIG. 9, showing further details of the clock mechanism.
Figure 15:
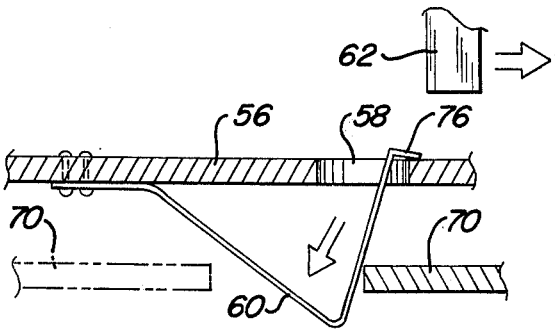
FIG. 15 is an enlarged fragmentary section, similar to FIG. 14, but showing the detent mechanism in released position.

A disc 56 is mounted on shaft 40 for rotation therewith and has three equally spaced apertures through which respective spring detents 60 extend. As best seen in FIG. 14, one leg of detent 60 is attached, as by rivets, to disc 56 and the other leg extends upwardly through aperture 58. The detent normally engages a downwardly projecting pin 62, as seen in FIGS. 13 and 14, on arm 32 so that upon rotation of disc 56 by clock motor 42, arm 32 and hence stylus 34 will be caused to rotate therewith. It will be noted that the arm of stylus 32 is fastened to a separate shaft 64 mounted in a lower bearing 66 on disc 56 and on upper bearing 68 on mounting support 50 and is held in place, as by a set screw 70, all is best seen in FIG. 13. During this motion the detent 60 is held in the raised position of FIG. 14 by means of a stationary plate 70 which is generally semicircular in configuration, as shown in FIG. 12. As seen in both FIGS. 12 and 13, the plate has a center aperture 72 through which clock motor shaft 40 extends and the plate is held in place, as by set screws 74. As best seen in FIGS. 8, 10 and 11, plate 70 is positioned so that it holds detents 60 in raised position as the stylus moves to cast a shadow across the clock face. However, when the stylus reaches the 12:59 position the detent 60 which has been against depending pin 62 rides off the top surface of plate 70 and moves to a lower position, as shown in FIG. 15, wherein pin 62 is released so that the stylus goes back to the one o'clock position by spring 44 and the upper end of detent 60 is caught by means of a lip 76 thereon so that the end of the detent does not fall through aperture 58. When the stylus has swung back to the one o'clock position, it will be picked up by another detect which is moved to raised position by its lower leg sliding along plate 70 which can be best understood by referring to the portion of plate 70 shown in phantom in FIG. 15 which would cause the detent 60 to be raised again for engagement with the pin 62 when it swings to the other side of the clock.

Figure 16:
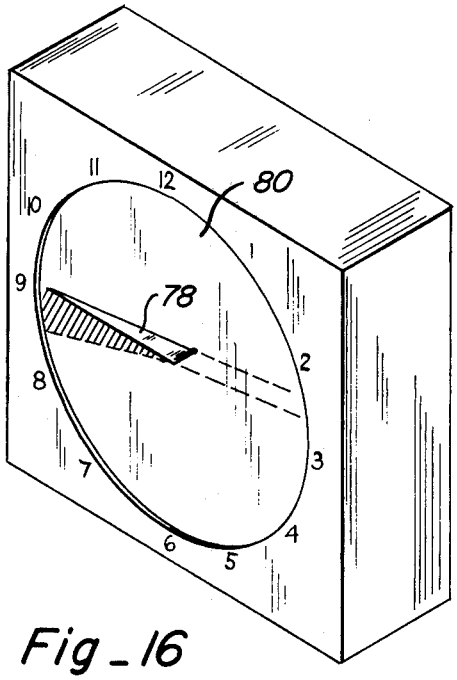
FIG. 16 is a perspective view of a still further embodiment of the present invention.

A further embodiment is shown in FIG. 16 wherein a stylus 78 is rotatably mounted on a clock face 80. The clock is provided with a plurality of light sources (not shown) at each of the hour positions around the clock and are selectively lighted to cast a shadow of stylus 78 onto the clock face adjacent the appropriate numerals, as will be understood from the description of the embodiments of FIG. 1 and 2.

Figure 17:
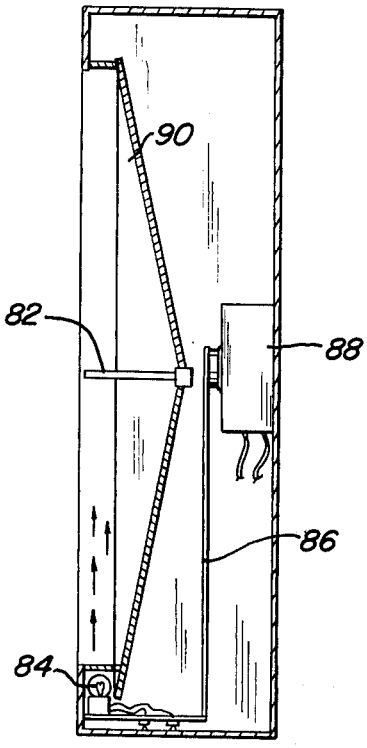
FIG. 17 is a vertical section through another form of the invention utilizing a rotating light source in a stationary stylus.

A still further embodiment is shown in FIG. 17 wherein a stationary stylus 82 is provided at the center of the clock and a single illuminating source 84 is mounted on an arm 86 rotatable by a clock motor 88 to cast a shadow of the stationary stylus across face 90 of the clock to cast a shadow adjacent indicia spaced around the clock face.

Figure 18:
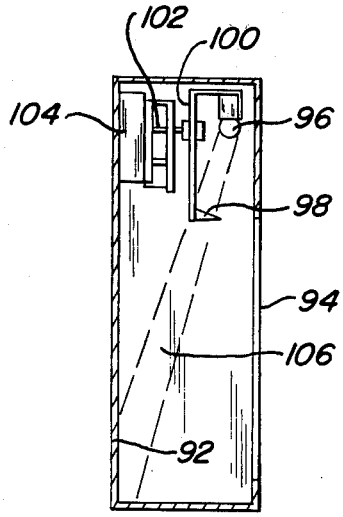
FIG. 18 is a vertical section, on a reduced scale, similar to FIG. 17 but showing an embodiment which is adapted to be mounted on a wall wherein both the stylus and light source rotate on a common arm.
Figure 19:
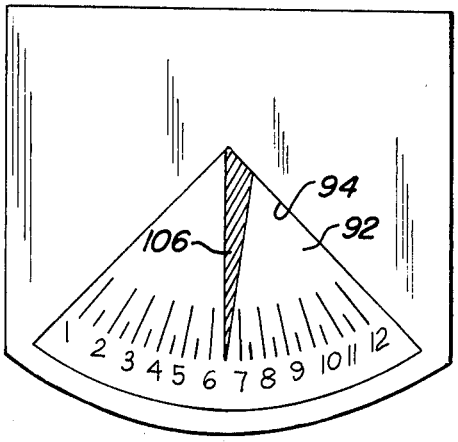
FIG. 19 is a plan view of the shadow clock of FIG. 18.

A still further embodiment is shown in FIG. 18 of a wall mounted clock having a recessed clock face 92 which can be viewed through an aperture 94. A shadow is cast thereon by means of a light source 96 which illuminates a stylus 98, the light source and stylus both being mounted on an arm 100 pivoted about a shaft 102 of a clock motor 104. Thus, a shadow 106 can be cast across the indicia on face 92 as best seen in FIG. 19.

Figure 20:
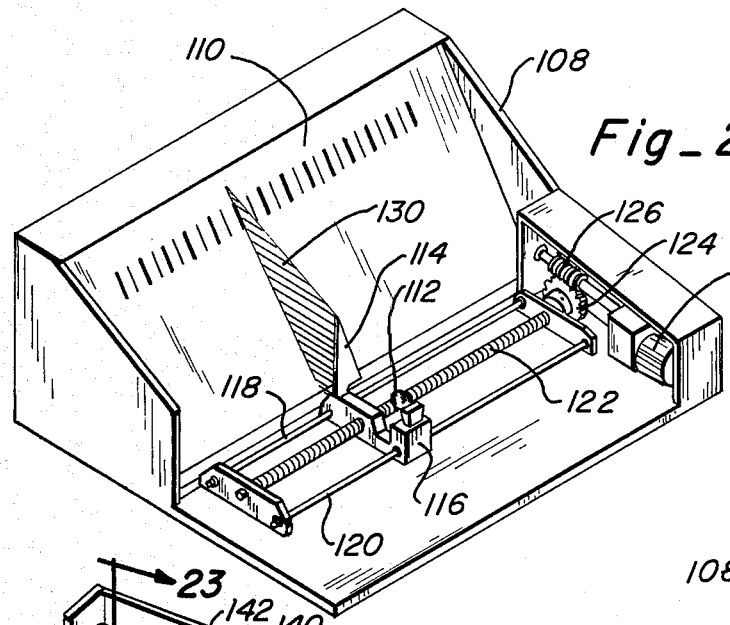
FIG. 20 is a perspective view of a still further modified embodiment with a portion of the housing removed to show the screw advance for moving the stylus and light source along a linear path.
Figure 21:
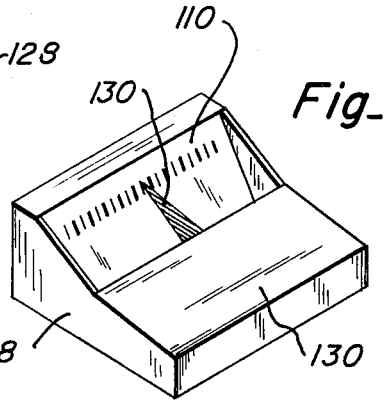
FIG. 21 is a perspective view, reduced in size, of the embodiment of FIG. 20.

A still further alternative embodiment is shown in FIG. 20 wherein a clock is provided having a housing 108. The housing is provided with a linear clock face 110 which includes suitable indicia as shown in FIGS. 20 and 21. A light source 112 and a stylus 114 are both mounted on a common bracket 116. The bracket is mounted for linear movement parallel to the clock face. Conveniently, the bracket 116 is mounted for sliding movement along spaced guide rails 118 and 120. The bracket is also mounted on a rotatable screw 122 which is driven through a gear 124 and worm 126 by a clock motor 128, as shown. As will be understood, the light source 112 shining on stylus 114 will cast a shadow 130 which will move across clock face 110 in timed relationship. Suitable means, not shown, can be provided for returning the bracket with its associated light source 112 and stylus 114 to the opposite end for movement in timed relationship for an equal time period. In FIG. 21, the clock of FIG. 20 is shown having a cover 130 which conceals the working mechanism of the clock.

Figure 22:
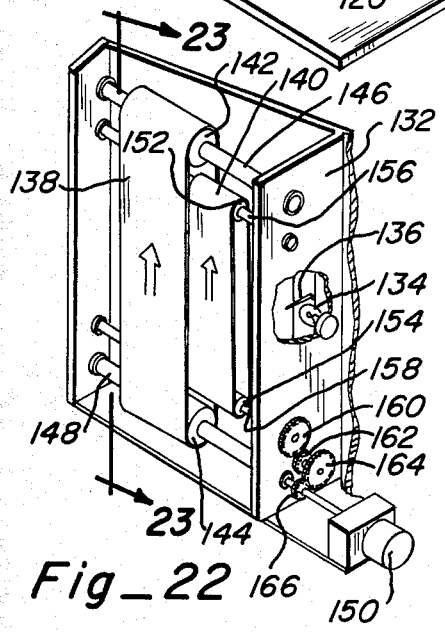
FIG. 22 is a perspective view of a still further modification, with parts broken away for clarity of illustration, wherein the clock face moves with respect to a stationary stylus and light source.
Figure 23:
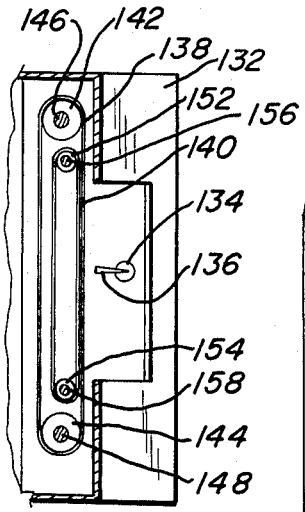
FIG. 23 is a vertical section, taken along Line 23—23 of FIG. 22, showing further details of the drive mechanism.
Figure 24:
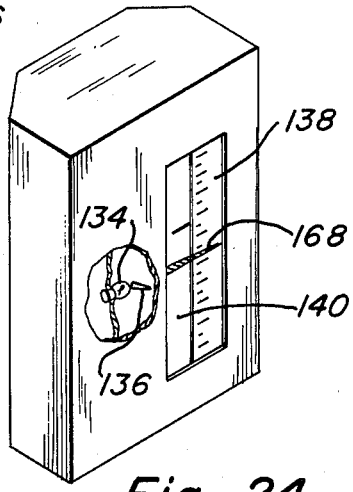
FIG. 24 is a perspective view of the embodiment of FIGS. 22 and 23 with parts broken away for clarity of illustration.

A still further embodiment of a clock mechanism is shown in FIGS. 22–24 in which a light source and stylus are mounted in fixed relationship with respect to each other. However, in this embodiment it is the clock face which moves rather than the stylus and light source. Thus, a housing 132 is provided wherein a light sourcd 134 is mounted for shining on a fixed stylus 136, as shown, for casting a shadow on movable clock faces 138 and 140 which are in the form of endless belts as shown. Conveniently, clock face or endless belt 138 is mounted on spaced rollers 142 and 144 which are mounted in shafts 146 and 148, respectively, which are journaled in the housing as shown. Conveniently, shaft 148 is connected to clock motor 150 and is driven in timed relationship thereby. Clock face 138 can be provided with indicia to indicate minutes as best seen in FIG. 24. Clock face 140 is mounted on spaced rollers 152 and 154 which are in turn mounted on shafts 156 and 158, respectively. The end of shaft 158 is provided with a gear 160 which is connected and turned through a gear chain including gears 162, 164 and 166, the latter being on shaft 148. Through this gearing arrangement, the speed of movement of clock face 140 is slowed down to 1/60th the movement of clock face 138 and is marked with indicia to indicate the hours, also as best seen in FIG. 24. Thus, a shadow 168 is cast by light source 134 shining on stylus 138 which shadow extends across both clock faces 138 and 140 to provide a time indication.

Figure 25:
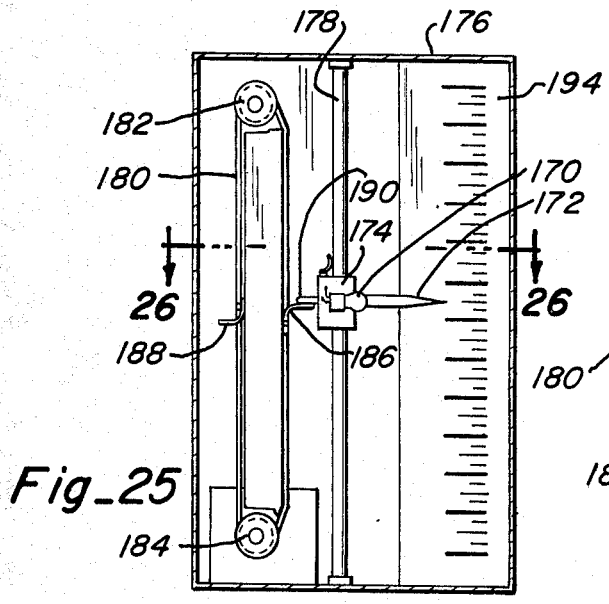
FIg. 25 is a vertical section of still another modification of the present invention wherein the stylus and light source are driven by an endless belt.
Figure 26:
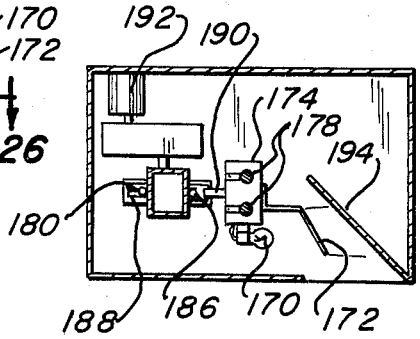
FIG. 26 is a horizontal section, taken along Line 26—26, of FIG. 25, showing further details of the drive mechanism.
Figure 27:
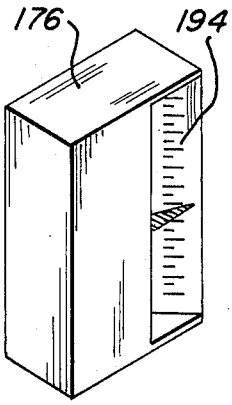
FIg. 27 is a perspective view, reduced in size, of the embodiment shown in FIGS. 25 and 26.

A still further embodiment is shown in FIGS. 25–27 wherein a light source 170 and a stylus 172 are fixedly mounted on a bracket 174 within a housing 176. The bracket is slidably mounted on a rod 178 and can either be spring urged toward one end or as shown can be normally urged toward a downward position by gravity. An endless belt 180 is supported by spaced pulleys 182 and 184, respectively, having a pair of lifting arms 186 and 188 which alternatively engage a pin 190 extending from bracket 174 for raising the bracket and its associated light and stylus due to rotational movement of the belt by means of a clock motor 192, shown in FIG. 126. Thus, as the clock motor 192 drives endless belt 180 the light and associated bracket will be caused to move upwardly and parallel to a clock face 194 having suitable indicia thereon, the stylus casting a shadow on the indicia giving an indication of the time. When the stylus reaches the top of the clock and lifting arm 186 goes over pulley 182, it will release bracket 174 and its associated light source and stylus so they drop to the lower end of rod 178 where they will then be picked up by the next lifting arm 188 and the operation will repeat. Of course, a suitable power source will be connected to the light source 170 to provide electricity thereto, the structure therefore being omitted for clarity of illustration.

From the foregoing, the advantages of this invention are readily apparent. A shadow clock has been provided which simulates a sundial by casting a real shadow from the illuminated stylus across a portion of the face of the clock to indicate the time. In one embodiment light sources are selectively activated about a circular clock face to cast a shadow by means of a stylus projecting from the clock face and in the path of the projected light. In a further embodiment, the light source is mounted in a stationary position while the stylus moves through a prescribed arc and casts a shadow across an arcuate clock face. In a still further embodiment, a single light source is mounted for movement around the clock face to cast a shadow of a stylus projecting from the center of the clock face. In a still further embodiment, the light source and stylus are both mounted for pivotal movement by means of a clock motor and cast a movable shadow across a clock face. Finally, several embodiments are provided wherein a light source and stylus are mounted in fixed position with respect to each other but are moved linearly with respect to a linear clock face so as to cast a shadow thereon. In one embodiment a screw drive is provided, in another embodiment an endless belt drive is used. Finally, an embodiment is provided wherein the light source and stylus are stationarily mounted in fixed position on a housing and cast a stationary shadow onto a movable clock face which is driven by a clock motor to give an appropriate indication of time.

The invention has been described in detail with particular reference to preferred embodiments thereof, but it will be understood that variations and modifications can be effected within the spirit and scope of the invention.

What is claimed is:

1. A clock for telling time by casting a shadow of a stylus, said clock comprising:

a face having indicia spaced thereacross to divide said face into time increments;

a stylus mounted for casting a shadow on said face;

artificial light projecting means for illuminating said stylus to cast a shadow of said stylus on said face, said light projecting means includes a single light source mounted for movement along said face in a path parallel to said indicia; and a clock motor connected to at least one of said stylus, said light projecting means and said face to cause relative movement between said shadow and said indicia in timed relation, said light projecting means being connected to said clock motor for movement of said light projecting means in timed relation.

2. A clock, as claimed in claim 1, wherein said stylus is stationary and is mounted at the center of said face.

3. A clock, as claimed in claim 1, wherein:

said light projecting means and said stylus are both mounted on a common pivotal arm, said arm being connected to and pivoted by said clock motor.

4. A clock, as claimed in claim 1, wherein:

said clock motor is connected to said stylus and light projecting means and moves them simultaneous along a path parallel to said indicia.

5. A clock, as claimed in claim 4, wherein:

said clock motor is connected to said stylus and said light projecting means through a screw threaded shaft.

6. A clock, as claimed in claim 4, wherein:

said clock motor is connected to said stylus and said light projecting means through an endless belt.

7. A clock for telling time by casting a shadow of a rotatable stylus, said clock comprising:

a face having indicia spaced therearound to divide said face into time increments;

a stylus extending outwardly from said face and extending from the center thereof toward said indicia and rotatable about said center;

a clock motor mounted behind said face connected to said stylus for rotating said stylus about said center of said face at a predetermined rate;

separate light projecting means spaced around the periphery of said face for selectively illuminating said stylus to cast a shadow of said stylus across the indicia opposite said light projecting means to give a readable time indication; and means selectively illuminating said light projecting means in response to the position of said stylus.

8. A clock, as claimed in claim 7, wherein:

said indicia includes numbers indicating the hours of the day located at each 30° of arc around said face; and each of said light projecting means is located adjacent one of said numbers of projecting light inwardly toward the center of the face and onto said stylus to cast a shadow across a portion of said numbers on the opposite side of said face.

9. A clock, as claimed in claim 8, wherein:

said stylus is generally in the shape of a right triangle having one leg extending perpendicularly from the face at the center thereof and a second leg extending parallel to the face toward the indicia and terminating in a point;

time increments marked between said numbers; and said selective illuminating means is responsive to illuminate a first light projecting means opposite the stylus when the stylus points to a first number and to remain illuminated until said stylus moves to a second number whereupon the next adjacent illuminating means which will then be opposite the stylus is illuminated and said first light projecting means is de-activated so that between the illumination of the first illuminating means and the illumination of the second illuminating means a shadow of said stylus is cast across the first number and across the number of increments between the first number and the point of the stylus.

10. A clock, as claimed in claim 7, wherein said light projecting means includes a reflector and hood for directing the light in a narrow beam across said stylus so that a sharp shadow is projected on said indicia.

11. A clock, as claimed in claim 9, wherein said selective illuminating means includes electrical contact means driven by the clock motor for selectively illuminating said light projecting means.

12. A clock, for telling time by casting a shadow from a rotatable stylus, said clock comprising:

a face having indicia spaced therearound which includes numbers located at 30° arc positions to represent the hours of the day and smaller increments between said numbers to represent one or more minutes between the hours;

a generally triangular stylus having one leg extending perpendicularly from the center of said face and the other leg extending parallel to said face toward said indicia, said stylus being rotatable across said face about said center;

a clock motor mounted behind said face connected to said stylus for pivoting said stylus about said center of said face at a predetermined rate;

light means spaced around the periphery of said face at each of said numbers for illuminating said stylus so that a shadow of said stylus is cast across the number opposite the illuminated light means to give a readable indication of the time; and means for selectively illuminating said light means opposite the number to which said stylus is pointing and remaining illuminated until said stylus moves to the next number whereupon the next light will be illuminated, said light means casting a shadow of said stylus from the indicia opposite thereto across the increments to the point of the stylus.

13. A clock for telling time by casting a shadow of a stylus, said clock comprising:

a face having indicia spaced thereacross;

a stationary light source spaced from said face;

a stylus movable between said light source and said face;

an arm pivotally mounted at one end adjacent said light source, and having said stylus mounted on the other end for swinging movement between said face and said light source so that said light source will cast a shadow of said stylus across the indicia on said face; and a clock motor having a shaft rotatable in timed sequence;

means responsive to rotation of said shaft for pivoting said arm to swing said stylus from an initial position at one end of said face to a final position at the other end of the face so that said shadow moves across said indicia in timed relation and to rapidly return said stylus from said final position to said initial position during continued rotation of said shaft.

14. A clock, as claimed in claim 13, wherein said responsive means includes:

a disc mounted for rotation with said shaft;

a plurality of detent means spaced around said disc and selectively engageable with said arm; and means for moving a detent to engageable position with said arm when positioned with said arm at said initial position and for moving said detents to a disengageable position after moving said arm to said final position.

15. A clock, as claimed in claim 14, wherein said moving means comprises:

a generally semi-circular stationary plate extending from said initial position to said final position below said disc; and said detent means being spring means which are normally urged to said disengageable position but are cammed into said engageable position upon contact with said plate during rotation of said disc.

* * * * *